United States Patent [19]

De Deugd et al.

[11] Patent Number: 4,876,477

[45] Date of Patent: Oct. 24, 1989

[54] COLOR TELEVISION DISPLAY TUBE

[76] Inventors: Johannes A. G. De Deugd; Josephus J. van Moorsel, both of Groenewoudseweg 1, Eindhoven, Netherlands

[21] Appl. No.: 137,050

[22] Filed: Dec. 23, 1987

Related U.S. Application Data

[63] Continuation-in-part of Ser. No. 642,743, Aug. 20, 1984, abandoned, which is a continuation of Ser. No. 536,225, Sep. 27, 1983, abandoned, which is a continuation of Ser. No. 270,285, Jun. 4, 1981, abandoned.

[30] Foreign Application Priority Data

Jun. 23, 1980 [NL] Netherlands ..... 8003611

[51] Int. Cl.[4] ..... H01J 29/07

[52] U.S. Cl. ..... 313/404; 313/407

[58] Field of Search ..... 313/404, 406, 405, 407, 313/402, 408

[56] References Cited

U.S. PATENT DOCUMENTS

| | | | |
|---|---|---|---|
| 3,600,622 | 8/1971 | Vitale | 313/405 |
| 4,300,071 | 11/1981 | Dougherty et al. | 313/407 |
| 4,387,321 | 6/1983 | Gijrath et al. | 313/406 |

FOREIGN PATENT DOCUMENTS

| | | | |
|---|---|---|---|
| 0195543 | 8/1986 | Japan | 313/407 |

*Primary Examiner*—Kenneth Wieder

*Attorney, Agent, or Firm*—Robert J. Kraus

[57] ABSTRACT

A color selection electrode (31) for a color television display tube is suspended in the corners of the display window (20) by means of suspension means including a flat resilient element (37). The resilient element (37) is connected to the color selection electrode (31) or to another element of the suspension means by means of a substantially punctiform connection (48). Because of the flexibility of the punctiform connection (48) the suspension means exerts minimal moments on the color selection electrode (31).

19 Claims, 5 Drawing Sheets

COLOR TELEVISION DISPLAY TUBE

This is a continuation-in-part of application Ser. No. 642,743, filed Aug. 20, 1984, now abandoned, which was a continuation of application Ser. No. 535,225 filed Sept. 27, 1983, now abandoned, which was a continuation of application Ser. No. 270,285 filed June 4, 1981, now abandoned.

BACKGROUND OF THE INVENTION

The invention relates to a color television display tube comprising an envelope having a substantially rectangular display window and a substantially rectangular color selection electrode which is suspended in the corners of the display window with the aid of suspension means comprising flat resilient elements.

Such a color television display tube is disclosed in U.S. Pat. No. 3,548,235. This patent describes means for the suspension of a color selection electrode, and in particular for a shadow mask which does not have a rigid supporting frame connected thereto. The shadow mask is formed from a substantially rectangular, comparatively flexible, thin metal sheet having a large number of apertures. A mask ring of substantially the same thickness as the mask sheet is connected to the edge of the sheet. The mask ring gives the shadow mask a certain rigidity along the sides, but the shadow mask can be comparatively easily twisted about the diagonals and consequently has four hinge points at the corners. The shadow mask is suspended in the four corners of the display window with the aid of suspension means which have flat resilient elements which permit expansion of the shadow mask when the temperature increases. The suspension means further comprise clamping springs which are secured in chamber-like recesses in the corners of the display window. The resilient elements are connected to the clamping springs at their free ends.

In such a suspension of the shadow mask the desired distance between the shadow mask and the display window is determined by all four suspension points in the corners of the shadow mask rather than by only three, because the shadow mask can be twisted about a diagonal. The position of the shadow mask relative to the display window in directions parallel to the display window is established by three of these four suspension points. The position of the fourth suspension point is determined by the other three points. The fourth suspension point should assume an equilibrium position relative to the other three points, but it is determined by the position of the clamping spring in the chamber-like recess. As a result of this moments are exerted on the shadow mask by the suspension means so that the shadow mask is deformed. In addition, forces which occur during shocks or vibrations of the display tube are transmitted largely to the shadow mask, causing fading in the displayed picture.

U.S. Pat. No. 3,999,098 discloses a suspension of a shadow mask in the corners of a display window in which the parts of the suspension means connected to the shadow mask are provided with very rigid leaf springs which extend substantially parallel to the tube axis. Three of the four leaf springs are each provided with an aperture. The fourth leaf spring includes a tapering mandril. The part of the suspension means connected to the display window is formed by four metal supports sealed in the corners of the display window and extending substantially perpendicularly to the diagonals of the display window. Three of the four supports are provided with respective tapering mandrils. The fourth support has a substantially rectangular slot. The leaf springs having apertures fall over the mandrils of the supports and the mandril of the fourth leaf spring falls in the rectangular slot of the fourth support. The fourth suspension point together with the three other suspension points establish the distance between the shadow mask and the display window. The position of the shadow mask in directions parallel to the display window is established by three identical suspension points in the corners of the shadow mask. Since the mandril of the leaf spring at the fourth suspension point is provided in the rectangular slot of the fourth support, the fourth suspension point can seek an equilibrium position.

The natural rigidity of the shadow mask in such a suspension system is relied on to withstand the forces which the very rigid leaf springs exert. In addition, the position of the shadow mask is not unambiguously established because the position of the fourth suspension point is not fixed and poor assembly reproducibility is obtained during repeated attachment and removal of the shadow mask to and from the display window. This repeated attachment and removal of the shadow mask is necessary when the display screen is photographically provided on the window. Assembly reproducibility is to be understood to mean herein the extend to which the shadow mask resumes the same position each time it is reattached.

SUMMARY OF THE INVENTION

It is an object of the invention to provide suspension means for a color selection electrode in a color television display tube which does not rely on the natural rigidity of the color selection electrode and which does not exert substantial moments on the color selection electrode.

Another object of the invention is to provide means for suspending a color selection electrode in a color television display tube in which shocks or impacts to the tube cause substantially no microphony or fading of the displayed picture.

Another object of the invention is to provide a suspension means for a color selection electrode in a color television display tube in which the color selection electrode, after repeated attachment and removal, always accurately resumes the same position or, in other words, has good assembly reproducibility.

Still another object of the invention is to provide a suspension means for a color selection electrode in a color television display tube in which means is not necessary to compensate for the differences in expansion between the color selection electrode and the display window when the display tube is warming up to the operating temperature.

According to the invention, a color television display tube of a kind mentioned in the opening paragraph is characterized in that the connection of one end of each resilient element to another element of the suspension means is a substantially punctiform or point connection.

The invention is based on the following principles. A color selection electrode is constructed from a comparatively flexible mask sheet having a mask frame or a mask ring. The sides of the mask frame or mask ring are rigid in the direction perpendicular to the plane of the mask sheet. However, the shadow mask as a whole can easily be twisted about the diagonals and therefore has four hinge points at the corners of the mask frame or mask ring. The position of the shadow mask relative to the display window is fixed unambiguously, if eight and only eight degrees of freedom of the shadow mask are fixed. Four of these degrees of freedom are necessary to unambiguously fix the distance from the corner points of the shadow mask to the display window. As a result of this the distance from the color selection electrode to the display window is unambiguously fixed. The remaining four degrees of freedom which are fixed must prevent movement of the corner points of the color selection electrode in a direction perpendicular to the diagonals in the plane of the color selection electrode. All other directions of movement are permitted. Since the corner points of the color selection electrode cannot move in a direction at right angles to the diagonals in the plane of the mask, the position of the color selection electrode relative to the display window is unambiguously fixed.

In a color television display tube according to the invention the above-mentioned principles are put into practice as follows. The resilient elements of the suspension means are rigid in the planes of the elements themselves. As a result of this and since the position of each resilient element is unambiguously fixed relative to the part of the suspension means connected to the display window, the distance from the four corner points of the color selection electrode to the display window is unambiguously fixed, so that four degrees of freedom of the color selection electrode are fixed. The single substantially punctiform connection which forms a so-called ball joint with which each resilient element is connected, ensures that the corner points of the color selection electrode cannot move in a direction perpendicular to the diagonal in the plane of the mask so that as a result of this four degrees of freedom are also fixed. The remaining degrees of freedom of the corner points of the color selection electrode ensure that the color selection electrode assumes a position relative to the display window in which the suspension means exert no moments on the color selection electrode.

Since the position of the color selection electrode has been fixed rotationally symmetrical relative to the center of the color selection electrode, no rotation of the color selection electrode occurs upon radial thermal expansion of the color selection electrode.

When the display tube is warming up, the color selection electrode expands and in order to maintain good color purity a decreased distance from the color selection electrode to the display window is necessary. As a result of the resilient action of the flat resilient elements, the color selection electrode moves toward the display window when the color selection electrode is warming up.

An embodiment of a color television display tube in accordance with the invention is characterized in that each substantially punctiform connection is made at the end of the resilient element facing the color selection electrode, that a carrier plate is connected to the end of the resilient element, and that a part of the suspension means connected to the display window comprises a supporting plate for connection to the carrier plate.

As a result of this the ball joint is situated as close as possible to the suspension point of the color selection electrode and a firm connection can be made of the end of the flat resilient element to the display window. Since the ball joint is situated close to suspension point of the color selection electrode, the forces occurring in the case of vibrations and shocks cause substantially no deformations of the color selection electrode and hence substantially no fading in the observed picture.

Another embodiment of a color television display tube in accordance with the invention is characterized in that the carrier plate and the supporting plate are secured together by detachable means. When providing luminescent phosphor patterns on the display window, the color selection electrode must be repeatedly attached to and removed from the display window. By use of this detachable means, the color selection electrode can be removably attached to the display window in a simple manner.

Another embodiment of a color television display tube in accordance with the invention is characterized in that one of each supporting plate and the respective carrier plate includes three embossments situated at the corners of a triangle, two of the embossments being larger than the third, and the other plate has two apertures into which the two larger embossments fall. The supporting plate and carrier plate are held together by a detachable clamping member, the point of engagement of which is situated within the triangle. In order that the color selection electrode always accurately resumes the same position after removal and reattachment, the position of the carrier plate relative to the supporting plate should be unambiguously determined. Since the apertured plate engages the three embossments of the other plate and the two plates are held together by a clamping member, the position of the carrier plate relative to the supporting plate is unambiguously fixed.

In the apertured plate, the first aperture is preferably in the form of a triangle against the side of which one of the larger embossments of the other plate contacts at three respective points. The second aperture is preferably in the form of a rectangle against two sides of which the second larger embossment contacts at two respective points. These five points of contact together with the supporting point formed by the third embossment on the one plate produce an unambiguous position in all directions of the carrier plate relative to the supporting plate. The clamping member holds the carrier plate and the supporting plate together.

Another embodiment of a color television display tube in accordance with the invention is characterized in that a part of the suspension means connected to the display window has a clamping spring which is clamped in a chamber-like recess in a corner of the display window. The supporting plate may be connected to the clamping spring or form part hereof. The part of the suspension means connected to the display window in this manner assumes a fixed position.

This fixed position of the part of the suspension means connected to the display window can be formed according to further embodiments of a color television display tube in accordance with the invention by a metal plate which is cemented in a chamber-like recess in the corner of the display window or by a supporting element embedded in the glass.

It is to be noted that the connection of a metal plate in the chamber-like recesses by means of a cement forms the subject matter of patent application Ser. No. 270,444 (PHN 9772) filed simultaneously with this application.

BRIEF DESCRIPTION OF THE DRAWING

The invention will be described in greater detail, by way of example, with reference to the accompanying drawing, of which.

DESCRIPTION OF THE PREFERRED EMBODIMENTS

Figure 1:
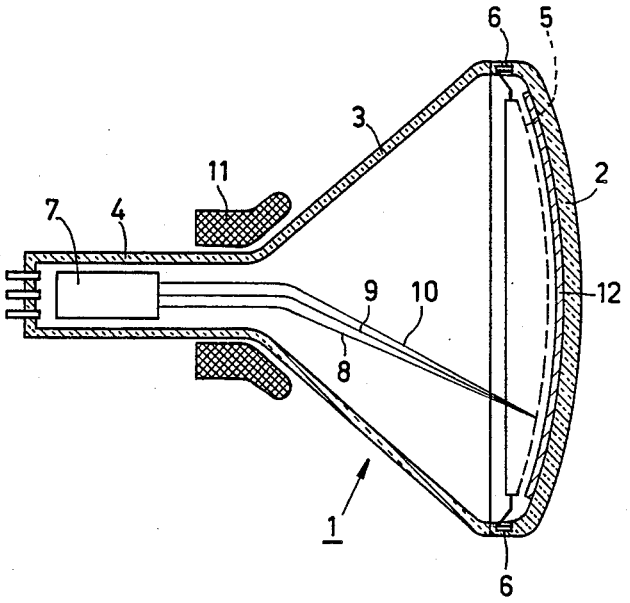
FIG. 1 is a longitudinal sectional view of a color television display tube according to the invention.

The color television display tube shown in FIG. 1 is formed by a glass envelope 1 which has a substantially rectangular display window 2, a cone 3 and a neck 4. A pattern of triplets of phosphors 12 luminescing in the colors red, green and blue is provided on the display window 2. At a short distance from the display screen a color selection electrode 5 is mounted by means of suspension means 6 to which the invention relates. An electron gun 7 for generating three electron beams 8, 9 and 10 enclosing a small angle with each other is mounted in the neck 4 of the tube. These three beams are deflected by means of a system of deflection coils 11 placed around the tube and intersect each other substantially at the area of the color selection electrode 5, after which each of the electron beams impinges only on one of the three phosphors provided on the display screen.

The manner in which the color selection electrode 5 is secured in the corners of the display window 2 with the aid of the suspension means 6 will be explained in greater detail with reference to FIG. 2 which is a perspective view of a corner of the glass display window. For clarity, the suspension of the color selection electrode is shown as an exploded view. The display window 20 includes a faceplate 21 and a perpendicularly extending skirt 22. The display screen 23 comprises an aluminum coating and phosphors which luminesce in three colors is provided on the faceplate 21. A chamber-like recess 24 is provided in the corner of the skirt 22. A clamping spring 25 formed from a strip having two bent ends 26 is disposed in the recess. Instead of a clamping spring 25 a metal strip may be used which is fixed in the chamber-like recess 24 by means of a cement. A supporting plate 27 forms part of or is secured to the spring 25. The supporting plate 27 has three embossments 28, 29 and 30. The embossments 28 and 29 are larger than the embossment 30. The supporting plate 27 encloses such an angle with the axis of the display tube that it extends perpendicularly or substantially perpendicularly to the electron beams which are directed toward the corner of the display window. The color selection electrode 31 is formed from a thin mask sheet 32 having a flange 34 and a large number of apertures 33. A mask ring 35 is connected to the flange 34 and forms a diaphragm for preventing reflection of electrons by the flange 34. In order to avoid differences in expansion between the color selection electrode 31 and the mask ring 35 during warmup of the tub, both are manufactured from the same material and have approximately the same thickness. The corner of the mask ring 35 is reinforced by means of a supporting strip 36. A flat resilient element in the form of a leaf spring 37, is connected to the supporting strip 36 by means of a single substantially punctiform connection which is shown in detail in FIG. 3.

Figure 6:
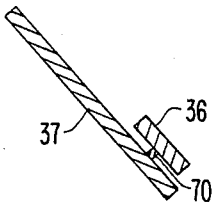
FIGS. 6 to 8 are sectional vieWs showing embodiments of a punctiform connection of a leaf spring to a supporting strip.

Such a punctiform connection may be formed by a spot weld 70 as is shown in FIG. 6. FIG. 6 shows an enlarged sectional view of the leaf spring 37 and the supporting strip 36 in which the dimension of the spot weld 70 is exaggerated for the sake of clarity. By spot welding the leaf spring 37 and the supporting strip 36 some of the material of these elements melts and, after solidification, this melted material forms a bridge between the leaf spring and the supporting strip thus, allowing a small mutual rotation of these two elements. The leaf spring 37 is connected to a carrier plate 38 which has a triangular aperture 39 and a rectangular aperture 40 (see FIG. 2). The color selection electrode 31 is secured in the display tube by placing the carrier plate 38 onto the supporting plate 27. The carrier plate 38 contacts the embossment 30 and the spherical embossments 28, 29 fall partly through the apertures 39 and 40. The spherical embossment 29 contacts the edges of the triangular aperture 39 at three points and the spherical embossment 28 contacts the edges of the rectangular aperture 40 at two points.

The supporting plate 27 and the carrier plate 38 are held together by a detachable clamping member 41. This clamping member 41 is formed from a resilient metal plate 42 to form a tab having one end 43 bent over to form a tab. The other end is bent to form a clamp 44 by which the supporting plate 27 and the carrier plate 38 are held together. The plate 42 furthermore comprises a lug 45 which is used to facilitate detachments of the clamping member 41.

The position of the carrier plate 38 relative to the supporting plate 27 is unambiguously fixed in all directions in this manner. The distance between the carrier plate 38 and the supporting plate 27 is determined by the three embossments 28, 29 and 30 by means of which the supporting plate 27 contacts the carrier plate 38 at six points of contact. Translations of the carrier plate 38 in a direction perpendicular to and rotations about an axis perpendicular to the supporting plate 27 are thus not possible. The clamping member 41 holds the supporting plate 27 and the carrier plate 38 together. The clamp 44 preferably contacts the carrier plate 38 at the center of a triangle having corner points at the three embossments 28, 29 and 30. As a result of this the forces are uniformly divided over the embossed portions and forces are avoided which might cause the carrier plate 38 to warp relative to the supporting plate 27, thus ensuring clamping of the carrier plate 38 against the supporting plate 27.

Figure 2:
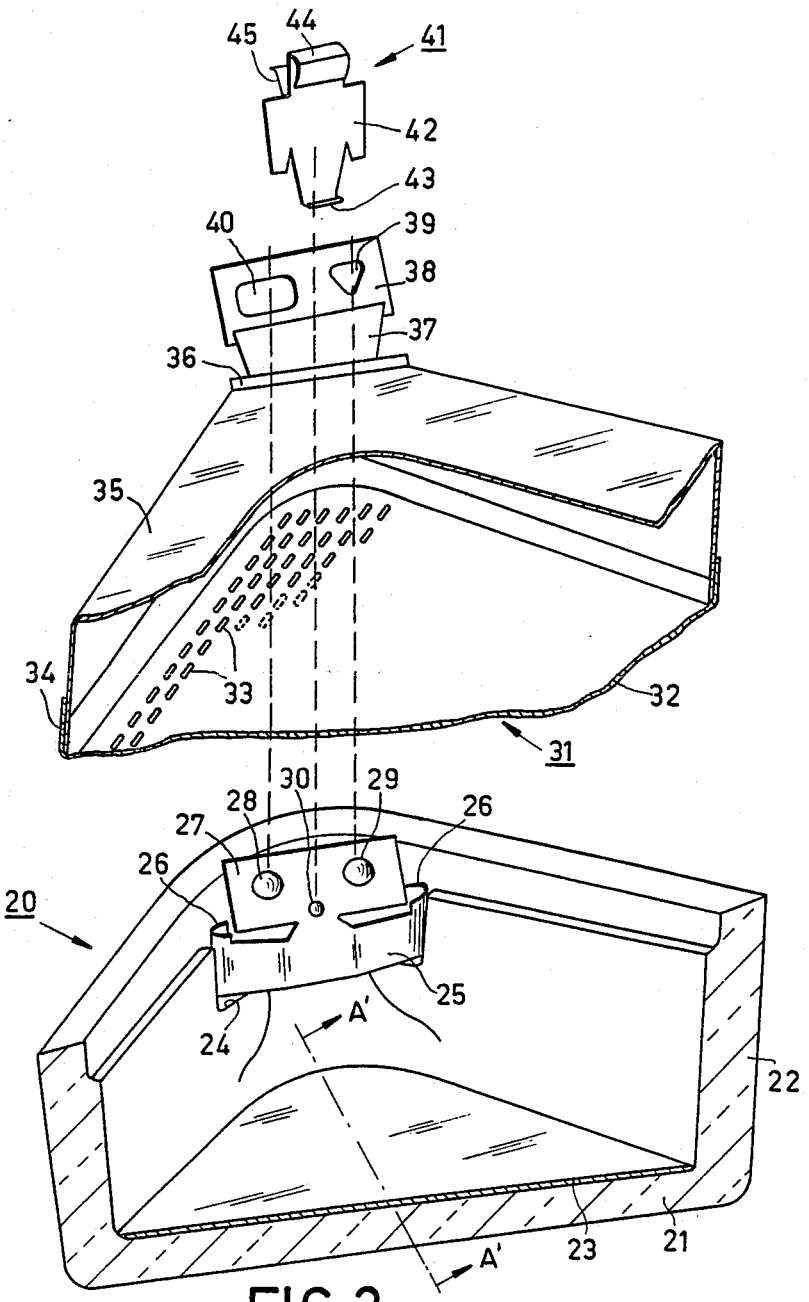
FIG. 2 is a perspective exploded view of an embodiment of a suspension of the color selection electrode in a corner of the display window.
Figure 3:
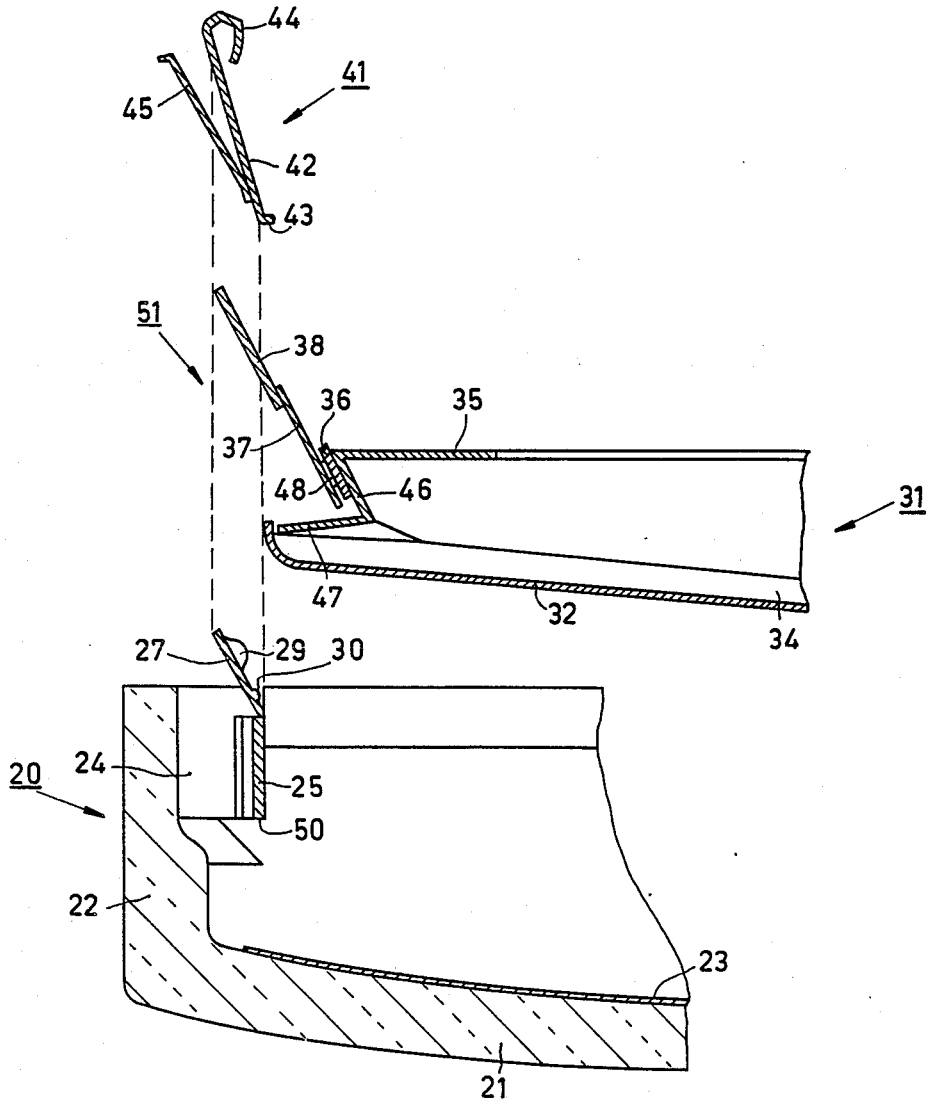
FIG. 3 is a sectional view taken on the line A'A' of FIG. 2.
Figure 7:
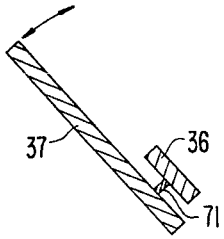

FIG. 3 is a sectional view taken on the line A'A' shown in FIG. 2. The color selection electrode 31 is formed from an apertured mask sheet 32 bent over near the edges to form flange 34. Connected to the flange 34 is the mask ring 35 having a corner portion 46 bent over inwardly and a lug 47 bent over outwardly. The lug 47 serves to improve magnetic screening. A reinforcement strip 36 is connected to the corner portion 46. A leaf spring 37 is connected to the reinforcement strip 36 by means of a single substantially punctiform connection 48 between the leaf spring 37 and the supporting strip 36. Such a punctiform connection 48 may be formed by a very small intermediate member 71 as is shown in FIG. 7, which preferably is made of a material with the same thermal expansion coefficient as the material of which the flat resilient member or the carrier member is made. Such an intermediate member 71 also spaces the leaf spring 37 from the supporting strip 36 and allows an additional degree of rotation in the direction shown by the arrow in FIG. 7. A suitable material would be the material of which the color selection electrode is made. This material is well known to a person skilled in the art. The intermediate member of this material will form a punctiform connection when its surface has a cross-sectional area of 0.5 square cm. The leaf spring 37 is very rigid in the plane of the spring itself but is comparatively flexible in a direction at right angles thereto. The carrier plate 38 which has the above-described triangular and rectangular apertures is connected to the leaf spring 37 (see FIG. 3). The carrier plate 38 is placed on the supporting plate 27 with the two larger embossments 28 and 29 of the supporting plate falling through the two apertures in the carrier plate 38 and the smaller embossment 30 of the supporting plate contacting the carrier plate 38.

A rigid engagement of the carrier plate 38 and the supporting plate 27 is produced by means of the clamping member 41. The clamping member 41 is moved over the supporting plate 27 and the carrie plate 38 with clamp 44 holding the supporting plate 27 and the carrier plate 38 together. The tab 43 of clamping member 41 falls over the lower edge 50 of the clamping spring 25 to which the supporting plate 27 is connected. This prevents the clamp 44 from sliding along the surface of the carrier plate 38. When the color selection electrode is removed, as is necessary when providing the phosphor pattern on the display window, the clamping member 41 is detached by pressing the lug 45 toward the plate 42. As a result of this the tab 43 is released and the clamping member 41 can be detached.

Figure 8:
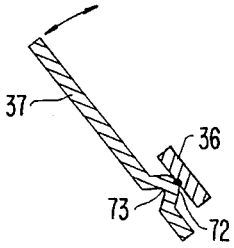

The supporting plate 27 is attached to the clamping spring 25 at such an angle that the supporting plate 27 is substantially at right angles to the path of the electron beams when directed to the corner of the display window 20. This is also the case for the carrier plate 38 having the leaf spring 37 attached thereto which in turn is attached to the color selection electrode 31 via the punctiform connection 48. Such a punctiform connection 48 may be formed by providing the leaf spring 37 with a small local depression 72 and connecting the supporting strip 36 thereto, for example by means of a spot weld 73. The local depression 72 spaces the leaf spring 37 from the supporting strip 36 and allows an additional degree of rotation in the direction shown by the arrow in FIG. 8. Because of this additional degree of rotation such a punctiform connection is called a ball-joint connection. The local depression also may be formed on the supporting strip.

When warming up the display tube the color selection electrode 31 moves in a direction toward the glass faceplate 21 as a result of the expansion of the color selection electrode and the movement which the leaf springs 37 make possible. As is known, at increased temperatures a smaller distance between the slightly expanded color selection electrode and the display window is necessary to maintain a good color purity. It is to be noted that a bimetallic element which is used in some known color display tubes for displacement of the color selection electrode toward the display window is not necessary in the above-mentioned suspension.

Figure 4:
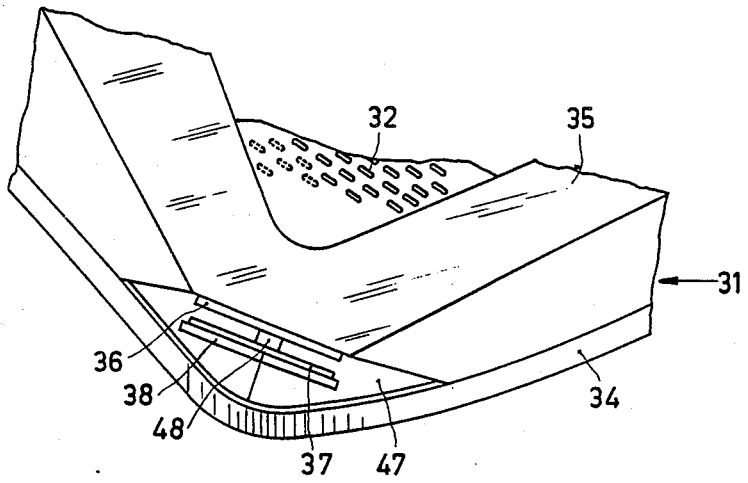
FIG. 4 is a perspective view of a corner of the color selection electrode of FIG. 2.

FIG. 4 is a perspective view of a corner of the color selection electrode 31 taken in a direction shown by arrow 51 in FIG. 3. The reinforcement strip 36 is connected to the corner of the mask ring. The leaf spring 37 is connected to the supporting strip 36 by means of a single substantially punctiform connection 48 for example by means of a metal intermediate member 48. In this manner the leaf spring 37 is connected to the supporting strip 36 over a small area. With the range of elasticity of the punctiform connection 48 the color selection electrode 31 can perform a small rotation about an axis through the punctiform connection which is perpendicular to an axis through the punctiform connection which is situated perpendicularly to a diagonal of the color selection electrode 31 and in the plane of the leaf spring 37 and about an axis through the punctiform connection which is situated perpendicularly to the plane of the color selection electrode 31. The single substantially punctiform connection forms a so-called ball joint. Due to this freedom of orientation and since the leaf springs 37 are comparatively flexible in a direction perpendicular to the plane of the leaf springs 37, the carrier plate 38 with the leaf springs 37 connected thereto can be clamped to the supporting plates 27 so that less moments are transmitted to the color selection electrode 31.

Since less moments are exerted on the color selection electrode 31 and the position of the carrier plate 38 is uniformly fixed relative to the fixed supporting plate 27, the color selection electrode 31, after repeated attachment to and removal from the display window, and after the occurrence of shocks, always accurately resumes the same position relative to the display window.

For example, the color selection electrode was taken out of the display window ten times and then placed in it again. The maximum deviation proved to be only 6 μm.

As a result of this assembly reproducibility of the color selection electrode the positions of the phosphor lines of the three successively provided phosphor patterns are accurately fixed relative to each other, so that the possibility of the occurrence of color defects is minimized.

Figure 5:
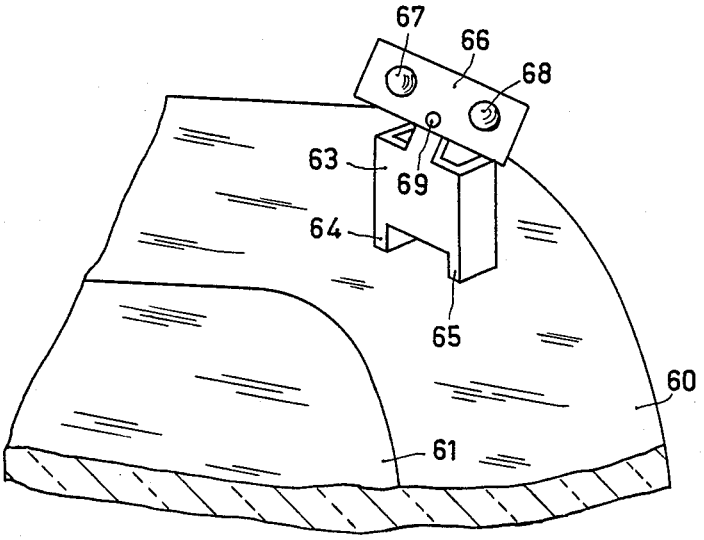
FIG. 5 is a perspective view of another embodiment of a supporting element for suspending a color selection electrode.

FIG. 5 shows another embodiment of a supporting element for suspension in accordance with the invention. The display window 60 is not provided in this case with a perpendicular skirt but is formed from a glass faceplate on which the display screen 61 having an aluminum layer is provided. In the corner of the faceplate 60 a supporting element 63 is provided which has a U-shaped profile and is provided with two limbs 64 and 65 which are embedded in the faceplate. A supporting plate 66 of the above-described construction having three embossments 67, 68 and 69 is attached to the element 63.

What is claimed is:

1. A color display tube comprising an envelope including a substantially rectangular display window, a substantially rectangular color selection electrode having four corner parts and means for mounting the color selection electrode to the display window, said means comprising:

(a) four supporting members, each attached to a respective corner of the display window; and (b) four carrier members, each attached to a respective corner part of the color selection electrode, each carrier member including:

(1) a flat resilient element, and (2) means for securing the flat resilient element to a respective one of the supporting members;

at least one of the flat resilient elements having a portion thereof affixed to a respective corner part of the rectangular color selection electrode by means of a single connection having a sufficiently small cross-sectional area in a first plane parallel to said portion to permit mutual rotation of the flat resilient element and the respective corner part of the color selection electrode in planes parallel to said first plane, to compensate for any rotational misalignment of the flat resilient element and the respective supporting member in a second plane parallel to the first plane.

2. A color display tube as in claim 1 where the connection comprises a spot weld.

3. A color display tube as in claim 1 where the connection comprises an intermediate member disposed between the flat resilient element and the respective corner part of the rectangular color selection electrode, said intermediate being dimensioned to further permit mutual rotation of the flat resilient element and said corner part in a third plane transverse to the first plane to compensate for any rotational misalignment of the flat resilient element and the respective supporting member in a fourth plane parallel to the third plane.

4. A color display tube as in claim 1 or 2 where the at least one flat resilient element includes a projection extending toward the respective corner part of the color selection electrode, said connection being formed on said projection.

5. A color display tube comprising an envelope including a rectangular display window, a rectangular color selection electrode, and means for mounting the color selection electrode to the display window, said means comprising:

(a) four supporting members, each attached to a respective corner of the display window; and (b) four carrier members, each carrier member including:

(1) a flat resilient element (2) means for s curing the flat resilient element to a respective one of the supporting members;

each resilient element being attached to a respective corner of the rectangular color selection electrode by means of a ball-joint connection.

6. A color display tube as in claim 1 where each carrier member includes a carrier plate affixed to one end of the flat resilient element and where each supporting member includes a supporting plate, respective carrier and supporting plates including means for engaging with each other to effect attachment of the color selection electrode to the display window.

7. A color display tube as in claim 6 where said means for securing the carrier members to the supporting members comprise detachable means for securing each carrier plate to a respective supporting plate.

8. A color display tube as in claim 7 where said means for engaging respective plates includes two larger projections and one smaller projection on a first one of the plates, arranged at locations defining corners of a triangle, and two openings in the second plate, and where the detachable means comprises a clamping member for holding the plates together with said larger projections extending into said openings, said smaller projection contacting a surface on the second plate and said clamping member clamping said plates together within an area defined by said triangle.

9. A color display tube as in claim 8 where the two openings in the second plate are triangular and rectangular, respectively, one of the larger projections being adapted for contacting three edges defining sides of the triangular opening and the other one of the larger projections being adapted for contacting two edges defining sides of the rectangular aperture.

10. A color display tube as in claim 1, 6, 7, 8, or 9 where each supporting member includes a clamping spring and where each corner of the display window includes a recess, each clamping spring being adapted for resilient engagement with walls defining a respective one of said recesses.

11. A color display tube as in claim 1, 6, 7, 8 or 9 where each supporting member includes a metal plate and where each corner of the display window includes a recess, each metal plate being fixed in a respective one of said recesses by means of cement.

12. A color display tube as in claim 1, 6, 7, 8 or 9 where a portion of each supporting member is embedded in a respective corner of the display window.

13. A color display tube as in claim 5 where each carrier member includes a carrier plate affixed to one end of the flat resilient element and where each supporting member includes a supporting plate, respective carrier and supporting plates including means for engaging with each other to effect attachment of the color selection electrode to the display window.

14. A color display tube as in claim 13 where said means for securing the carrier members to the supporting members comprise detachable means for securing each carrier plate to a respective supporting plate.

15. A color display tube as in claim 14 where said means for engaging respective plates includes two larger projections and one smaller projection on a first one of the plates, arranged at locations defining corners of a triangle, and two openings in the second plate, and where the detachable means comprises a clamping member for holding the plates together with said larger projections extending into said openings, said smaller projection contacting a surface on the second plate and said clamping member clamping said plate together within an area defined by said triangle.

16. A color display tube as in claim 15 where the two openings in the second plate are triangular and rectangular, respectively, one of the larger projections being adapted for contacting three edges defining sides of the triangular opening and the other one of the larger projections being adapted for contacting two edges defining sides of the rectangular aperture.

17. A color display tube as in claim 5, 13, 14, 15 or 16 where each supporting member includes a clamping spring and where each corner of the display window includes a recess, each clamping spring being adapted for resilient engagement with walls defining a respective one of said recesses.

18. A color display tube as in claim 5, 13, 14, 15 or 16 where each supporting member includes a metal plate and where each corner of the display window includes a recess, each metal plate being fixed in a respective one of said recesses by means of cement.

19. A color display tube as in claim 5, 13, 14, 15 or 16 where a portion of each supporting member is embedded in a respective corner of the display window.

* * * * *